US008595975B2

(12) United States Patent
van de Water

(10) Patent No.: US 8,595,975 B2
(45) Date of Patent: Dec. 3, 2013

(54) GATEWAY FOR PROVIDING CONTROLLED ACCESS FROM AN ENTRANCE POINT TO AN EXIT POINT

(75) Inventor: Niels van de Water, Badhoevedorp (NL)

(73) Assignee: Royal Boon Edam International B.V., Edam (NL)

( * ) Notice: Subject to any disclaimer, the term of this patent is extended or adjusted under 35 U.S.C. 154(b) by 0 days.

(21) Appl. No.: 13/572,395

(22) Filed: Aug. 10, 2012

(65) Prior Publication Data

US 2013/0031838 A1 Feb. 7, 2013

Related U.S. Application Data

(63) Continuation of application No. PCT/NL2012/050161, filed on Mar. 16, 2012.

(30) Foreign Application Priority Data

Mar. 24, 2011 (NL) ..... 2006465

(51) Int. Cl.
*E06B 3/48* (2006.01)

(52) U.S. Cl.
USPC ..... 49/68; 49/34; 49/44; 49/93; 49/95

(58) Field of Classification Search
USPC ..... 49/34, 35, 44, 42, 68, 93–95, 46, 9, 45; 109/2, 3, 6–8
See application file for complete search history.

(56) References Cited

U.S. PATENT DOCUMENTS 220,624 A * 10/1879 Jörgensen ..... 49/49
3,742,647 A * 7/1973 Tomita ..... 49/35
3,753,317 A * 8/1973 Turpin et al. ..... 49/35
4,261,297 A * 4/1981 Van Maarion et al. ..... 119/840
4,538,808 A * 9/1985 Holland ..... 473/447
5,634,295 A * 6/1997 Bunzl ..... 49/45
5,845,692 A * 12/1998 Kellem et al. ..... 160/118
6,185,867 B1 * 2/2001 McGuire ..... 49/109
6,688,555 B1 * 2/2004 Kneisl ..... 244/118.5

FOREIGN PATENT DOCUMENTS

WO WO99/64708 12/1999

* cited by examiner

*Primary Examiner* — Katherine Mitchell
*Assistant Examiner* — Marcus Menezes
(74) *Attorney, Agent, or Firm* — Peacock Myers, P.C.; Jeffrey D. Myers

(57) ABSTRACT

Gateway for providing controlled access from an entrance point to an exit point, having two wall elements defining a corridor in between the wall elements, and having a movable close off element or elements that have an open position and a closed position, whereby in the open position the corridor between the entrance point and the exit point provides a free passageway, and whereby in the closed position the corridor is closed off and passage from the entrance point to the exit point is prevented, wherein the movable close off elements or elements is/are embodied as at least one flexible band movable from within a wall element to at least in part outside that wall element, whereby in the open position the flexible band (s) is/are substantially rectilinear and positioned inside the wall element, and whereby in the closed position the flexible band(s) is/are bent to extend at least in part outside the wall element towards the other wall element to close up the passageway.

8 Claims, 2 Drawing Sheets

GATEWAY FOR PROVIDING CONTROLLED ACCESS FROM AN ENTRANCE POINT TO AN EXIT POINT

CROSS-REFERENCE TO RELATED APPLICATIONS

This application is a continuation application of International Patent Application Serial No. PCT/NL2012/050161, entitled "Gateway for Providing Controlled Access from an Entrance Point to an Exit Point," to Royal Boon Edam International B.V., filed on Mar. 16, 2012, which is a continuation of Netherlands Patent Application Serial No. 2006465, entitled "Gateway for Providing Controlled Access from an Entrance Point to an Exit Point," filed on Mar. 24, 2011 and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The invention relates to a gateway for providing controlled access from an entrance point to an exit point, comprising two wall elements defining a corridor in between said wall elements, and comprising a movable close off element or elements that have an open position and a closed position, whereby in the open position the corridor between the entrance point and the exit point provides a free passageway, and whereby in the closed position the corridor is closed off and passage from the entrance point to the exit point is prevented.

2. Description of Related Art

Such a gateway is known from practice at is for instance used at Subway or airport facilities to provide controlled access to a particular space behind the exit point. It is common to provide such a gateway with a card reader or other means to provide for a check upon the authorization of a person that is desiring to pass the Gateway. It is however also known to apply a gateway without such authorization means, for instance at airports the known gateway is used to let passengers pass from the entrance point to the exit point, however prevents the passengers from returning from the exit point and go to the entrance point again.

Normally the wall elements of the known gateway are manufactured from brushed aluminium, whereas the movable close off element or elements are made from hardened glass, giving a high technical feel to the known gateway.

BRIEF SUMMARY OF THE INVENTION

It is an object of the invention to develop and propose an alternative Gateway which allows for a smaller footprint in terms of ecology, and further to provide such a gateway that is made more to human measure.

BRIEF DESCRIPTION OF THE SEVERAL VIEWS OF THE DRAWINGS

The at least in part conflicting requirements of such a gateway are properly met in a gateway according to the invention, which has the features of one of more of the appended claims.

The invention will hereinafter be further elucidated with reference to the drawing of an exemplary embodiment of the gateway according to the invention.

In the drawings:

FIG. 1 depicts a schematic representation in 3-D of the gateway according to the invention; and FIGS. 2A and 2B represent a flexible band as part of the gateway of the invention, shown however separate from the remainder of the gateway.

Whenever in the Figures the same reference numerals are applied, these numerals refer to the same parts.

DESCRIPTION OF THE INVENTION

Figure 1:
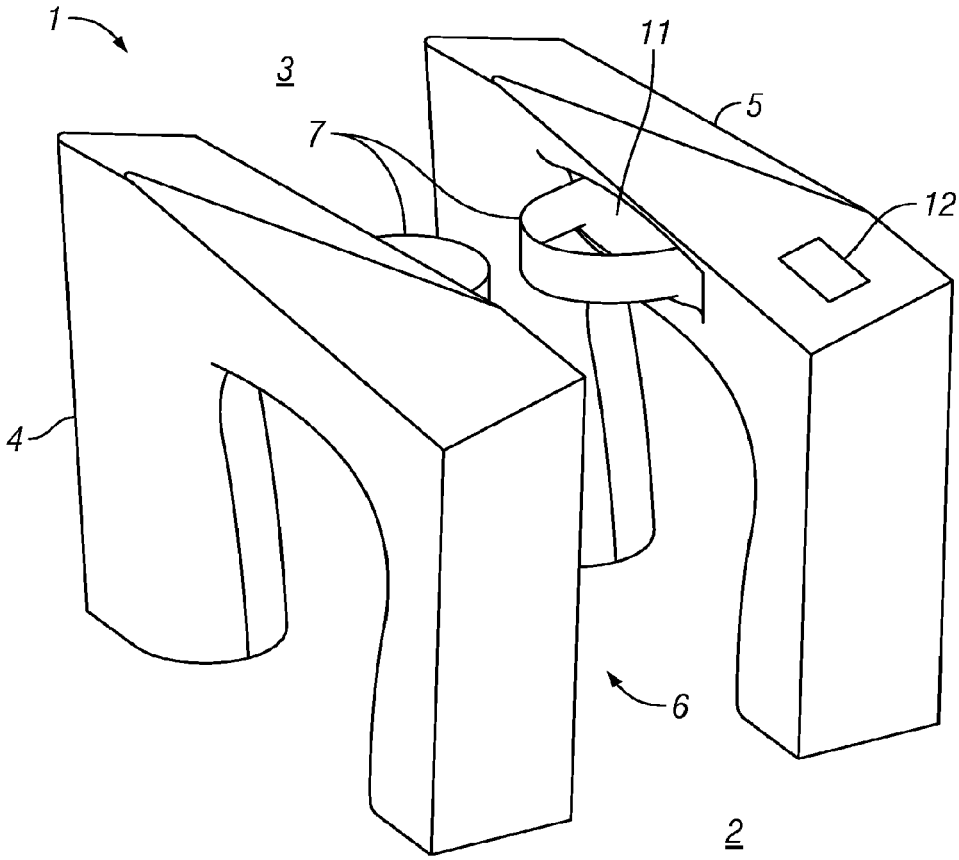

In a first aspect of the invention the gateway is characterized in that the movable close off elements or elements is/are embodied as at least one flexible band which at least one flexible band is movable from within a wall element to at least in part outside that wall element, whereby in the open position the at least one flexible band is substantially rectilinear and positioned inside the wall element, and whereby in the closed position the at least one flexible band is bent to extend at least in part outside the wall element towards the other wall element to close up the passageway. This ingenious design radically breaks with the existing technology according to which glass panels are moved in or out the passageway. In the design of the invention it is/are a flexible band or bands having by nature a friendly appearance that block or clear the passageway. The flexibility of the bands provides the notable advantage that the door of the invention is safe to use. Even if a person gets caught between the flexible bands, or between a flexible band and a wall element the danger of getting hurt is practically absent.

For the avoidance of doubt it is explicitly pointed out that one of the wall elements may be a (brick) wall, or even a fence. In case two wall elements of symmetrical design are employed, it is preferred although not necessary that each wall element is provided with a flexible band as will be discussed hereinafter.

Appropriately the gateway of the invention is provided with the feature that the band is suspended at its extremities between a first holder and a second holder of the band, whereby at least one of said holders is movable in order to reduce a distance between said holders so as to buckle out the band suspended between said holders from its position within the wall element to a position extending at least in part outside the wall element. When one imagines the realization of this daring thought, it is hard to conceive until one sees it actually reduced to practice the first time.

Preferably the gateway operates by having both the first holder and the second holder move to and fro each other.

The gateway of the invention can be practically embodied such that the first holder and/or the second holder are connected to a drive motor, the operation of which depends on an input device for checking a person's authorization to pass the corridor and go from the entrance point to the exit point.

Depending on the circumstances it may be preferred that the movable close off element or elements have the closed position as default position to provide the largest amount of security. In that connection it may further be preferable that the flexible band is spring-loaded to urge the band into the closed position when the power of the drive motor is off. A further advantage of this construction is that the force required for moving the flexible band(s) from the open position to the closed position and vice versa, is at least in part provided by the spring, which reduces the power required for operating the movable close off element or elements.

In another embodiment the movable close off element or elements have the open position as default position, whereby there is an input device for checking a person's authorization to pass the corridor, wherein the movable close off element or elements are operated to move to the closed position when the input device determines that person's lacking authorization to pass the corridor. This situation demonstrates one of the advantages of the gateway of the invention. The flexibility of the bands provides that the closing of the corridor by the flexible bands whereby a person gets caught between the flexible bands, or between a flexible band and a wall, does not result in that person getting hurt.

In a preferred embodiment the gateway comprises two flexible bands, wherein a first one of said two flexible bands is contained in a first wall element, and the second of said two flexible bands is contained in the second wall element, whereby the first wall element and the second wall element together define the corridor. This makes it possible to design and operate the gateway of the invention perfectly symmetrical.

It is further preferred that the two flexible bands operate concertedly, one of which being the master and the other one being the slave. This can easily be implemented by electronic means which are known for the person skilled in the art and require no further elucidation. Advantageously than the gateway can be operated such that in the open position both flexible bands are substantially contained in their respective wall elements, and that in the closed position both flexible bands are moved at least in part to the middle of the corridor abutting, or nearly abutting to each other.

According to a further aspect of the invention the wall element(s) is/are provided with a slit enabling that the at least one flexible band can move through said slit when moving from within a wall element to at least in part outside that wall element, which slit is provided with a flexible cover to protect against a person's limbs getting caught between the flexible band and the wall element.

Alternatively it is also possible that the wall element(s) is/are provided with a recess or recesses behind the flexible band(s) in order to arrange that with the flexible band(s) in the rectilinear position, clamping of a person's limbs between any flexible band and the wall element is prevented.

DETAILED DESCRIPTION OF THE INVENTION

Referring first to FIG. 1 the gateway of the invention is indicated with reference number 1. This gateway 1 provides controlled access from an entrance point 2 to an exit point 3, and comprises two wall elements 4, 5 defining a corridor 6 in between said wall elements 4, 5.

The gateway 1 further comprises a movable close off element or according to the shown embodiment—elements 7 that have an open position and a closed position. In the open position the corridor 6 between the entrance point 2 and the exit point 3 provides a free passageway. In the closed position, which is shown in FIG. 1, the corridor 6 is closed off and passage from the entrance point 2 to the exit point 3 is prevented.

Figure 2A:
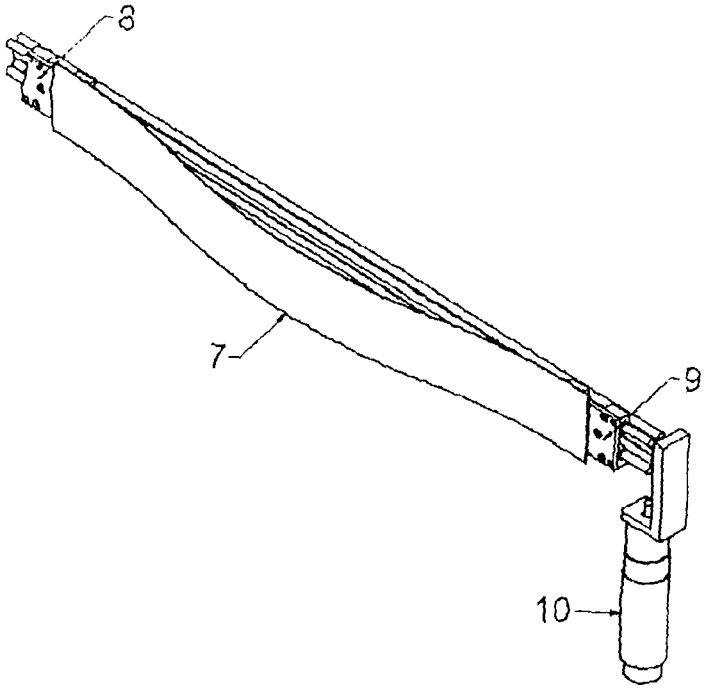

As FIG. 1 clearly shows the movable close off elements 7 are embodied as flexible bands, preferably steel bands. Each of the flexible bands 7 is movable from within a wall element 4, 5 to at least in part outside that wall element 4, 5, whereby in the open position the at least one flexible band 7 is substantially rectilinear as is shown in the detail of FIG. 2A. In this rectilinear condition the concerning flexible band 7 is positioned inside its corresponding wall element 4, 5. In the closed position on the other hand the flexible bands 7 are bent to extend at least in part outside their respective wall element 4, 5 towards the other wall element 5, 4 to close up the corridor 6 providing the passageway.

Figure 2B:
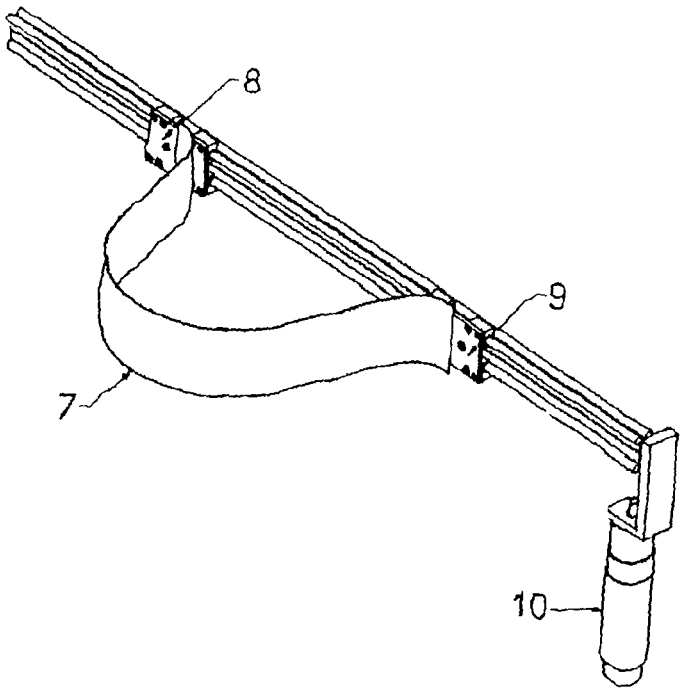

FIG. 2A further shows that the band 7 is suspended at its extremities between a first holder 8 and a second holder 9, whereby at least one of said holders 8, 9 is movable in order to reduce a distance between said holders 8, 9. FIG. 2B shows that by reducing this distance the band 7 is caused to buckle out. By this buckling of the band 7 it will move from its position within the wall element 4, 5 to a position extending at least in part outside the wall element 4, 5 and shut off the corridor 6 of the gateway 1.

Although it is possible that only one of said holders 8, 9 is movable, it is preferred that both the first holder 8 and the second holder 9 are movable to and fro each other. One thing and another can be appropriately realized by arranging that the first holder 8 and/or the second holder 9 are connected to a (schematically shown) drive motor 10. It is then preferred that when checking the authorization of passersby, the operation of the drive motor 10 is made to depend on an input device 12 for checking such persons authorization to pass the corridor and go from the entrance point 2 to the exit point 3.

It is further preferred that the movable close off elements 7 have the closed position as their default position, for which purpose it may be beneficial that the flexible band 7 is spring-loaded to urge the band into the closed position when the power of the drive motor 10 is off. The manner in which this can be implemented is immediately clear for the person skilled in the art and requires no further elucidation with reference to the drawing. Alternatively the movable close off element or elements 7 have the open position as default position, whereby it is then preferred that the movable close off element or elements 7 are operated to move to the closed position when the (not shown) input device determines a person's lacking authorization to pass the corridor 6.

Although the discussed embodiment is embodied with two flexible bands 7, wherein a first one of said two flexible bands is contained in a first wall element 4, and the second of said two flexible bands 7 is contained in the second wall element 5, it is also possible to provide only one of said two wall elements 4, 5 with a flexible band 7 that in that situation is made with a reach enabling it to cover the entire corridor 6.

In case two flexible bands 7 are applied, these bands 7 preferably operate concertedly, one of which being the master and the other one being the slave. From the above discussion it will be clear that these two flexible bands 7 are then preferably operated such that in the open position both flexible bands 7 are substantially contained in their respective wall elements 4, 5, and that in the closed position both flexible bands 7 are moved at least in part to the middle of the corridor abutting, or nearly abutting to each other.

There are numerous variations possible to the gateway 1 of the invention without departing from the scope of protection as afforded by the appended claims. It is for instance possible and in a certain embodiment also preferred that the wall element(s) 4, 5 is/are provided with a slit enabling that the at least one flexible band 7 can move through said slit 11 when moving from within a wall element 4, 5 to at least in part outside that wall element 4, 5, and that the slit is provided with a flexible cover (not shown) to protect against a person's limbs getting caught between the flexible band 7 and the wall element 4, 5.

It is also possible and shown in FIG. 1 that the wall element (s) 4, 5 is/are provided with a recess 11 or recesses behind the flexible band(s) 7 in order to arrange that with the flexible band(s) 7 in the rectilinear position clamping of a person's limbs between any flexible band 7 and the wall element 4, 5 is prevented.

What is claimed is:

1. Gateway for providing controlled access from an entrance point to an exit point, comprising two wall elements defining a corridor in between said wall elements, and one or more movable close off elements that have an open position and a closed position, whereby in the open position the corridor between the entrance pint and the exit point provides an unblocked passageway, and whereby in the closed position the corridor is closed off and passage from the entrance point to the exit point is prevented, wherein the one or more movable close off elements are embodied as at least one flexible band, such that the at least one flexible band is movable from within a wall element to at least in part outside the wall element, whereby in the open position the at least one flexible band is substantially rectilinear and positioned inside the wall element, and whereby in the closed position the at least one flexible band is bent to extend at least in part outside the wall element towards the other wall element to close up the passageway, and wherein the band is suspended at its extremities between a first holder and a second holder of the band, whereby at least one of said holders is movable in order to reduce a distance between said holders so as to buckle out the band suspended between said holders from its position within the wall element to a position extending at least in part outside the wall element.

2. Gateway according to claim 1, wherein both the first holder and the second holder are movable to and from each other.

3. Gateway according to claim 1, wherein one or both of the first holder and the second holder are connected to a drive motor, the operation of which depends on an input device for checking a person's authorization to pass the corridor and go from the entrance point to the exit point.

4. Gateway according to claim 1, wherein the one or more movable close off elements have the closed position as default position.

5. Gateway according to claim 1, wherein the one or more movable close off elements have the open position as default position, and there is an input device for checking a person's authorization to pass the corridor, wherein the one or more movable close off elements are operated to move to the closed position when the input device determines that person's lacking authorization to pass the corridor.

6. Gateway according to claim 1, comprising two flexible bands, wherein a first one of said two flexible bands is contained in a first wall element, and the second of said two flexible bands is contained in a second wall element, whereby the first wall element and the second wall element together define the corridor.

7. Gateway according to claim 6, wherein the two flexible bands operate concertedly.

8. Gateway according to claim 6, wherein in the open position both flexible bands are substantially contained in their respective wall elements, and in the closed position both flexible bands are moved at least in part to the middle of the corridor abutting, or nearly abutting, to each other.

* * * * *